US009258630B2

(12) United States Patent
Chu et al.

(10) Patent No.: US 9,258,630 B2
(45) Date of Patent: Feb. 9, 2016

(54) COAXIAL AUDIO SPEAKER USING SINGLE AUDIO SOURCE

(71) Applicant: Huiyang Dongmei Audio Products Co., Ltd., Guang Dong (CN)

(72) Inventors: Ming-Chung Chu, New Taipei (TW); Pin-Tang Lee, New Taipei (TW); Shoichi Taniguchi, Nara (JP)

(73) Assignee: Huiyang Dongmei Audio Products Co., Ltd., Guang Dong (CN)

( * ) Notice: Subject to any disclaimer, the term of this patent is extended or adjusted under 35 U.S.C. 154(b) by 19 days.

(21) Appl. No.: 14/326,758

(22) Filed: Jul. 9, 2014

(65) Prior Publication Data

US 2016/0014485 A1 Jan. 14, 2016

(51) Int. Cl.
*H04R 1/00* (2006.01)
*H04R 9/02* (2006.01)

(52) U.S. Cl.
CPC . *H04R 1/00* (2013.01); *H04R 9/025* (2013.01)

(58) Field of Classification Search
CPC ..... H04R 1/00; H04R 2205/022; H04R 2201/401; H04R 2201/405; H04R 1/02; H04R 1/025; H04R 1/026; H04R 9/00; H04R 29/003; H04R 2209/00; H04R 2209/41
USPC ..... 381/182, 386–388, 396, 398, 400–402, 381/412, 421
See application file for complete search history.

(56) References Cited

U.S. PATENT DOCUMENTS 2,426,948 A * 9/1947 Preston ..... H04R 7/12 381/182
3,796,839 A * 3/1974 Torn ..... H04R 1/24 381/182
4,492,826 A * 1/1985 Chiu ..... H04R 1/24 381/182
4,552,242 A * 11/1985 Kashiwabara ..... H04R 1/24 381/182
5,339,286 A * 8/1994 Esposto ..... H04R 1/24 381/182
5,548,657 A * 8/1996 Fincham ..... H04R 1/24 381/182
6,002,780 A * 12/1999 Espiritu ..... H04R 1/20 381/182
6,222,929 B1 * 4/2001 Kim ..... H04R 9/063 381/182
7,324,657 B2 * 1/2008 Kobayashi ..... H04R 9/063 381/182
8,150,077 B2 * 4/2012 Akino ..... H04R 1/245 381/182

* cited by examiner

*Primary Examiner* — Suhan Ni
(74) *Attorney, Agent, or Firm* — Muncy, Geissler, Olds & Lowe, P.C.

(57) ABSTRACT

A disclosed coaxial audio speaker may include a treble sound unit and a bass sound unit co-axially surrounding the treble sound unit. The bass sound unit may be in form of a single magnetic gap mechanism and have a magnetic-conductive base. The magnetic-conductive base may be with an auxiliary magnetic adjoining space and a coil movement space adjacent to the auxiliary magnetic adjoining space. A magnet, a vibrating vocal tone diaphragm along with a wiring board may be disposed within the coil movement space. A bass vibration audio source point and a treble vibration audio source point may be at the same horizontal level. Therefore, the size of the audio speaker may be reduced. And the broader electricity adjustability may be achieved as the bass vibration audio source point and the treble vibration audio source point may be horizontally aligned.

11 Claims, 11 Drawing Sheets

COAXIAL AUDIO SPEAKER USING SINGLE AUDIO SOURCE

BACKGROUND

1. Technical Field

The present disclosure relates to an audio speaker, in particular, to an audio speaker with Z-shaped cross-sectional magnetic-conductive base. Specially, the audio speaker employs a bass sound unit and a treble sound unit surrounded by the bass sound unit. Further, a bass vibration audio source point and a treble vibration audio source point may be aligned at the same horizontal level.

2. Description of Related Art

Traditional earphones or audio speakers are equipped with one single amplifier (sound unit) and that renders difficult the realization of a broad range of listening experience. And certain tradeoff becomes necessary if the bass performance needs to be enhanced (at the expense of the treble performance). Even for achieving the goal of the above mentioned broad listening experience, multiple separate sound units (for example, distinct treble sound unit and bass sound unit) need to be placed within the earphones or the audio speakers, occupying additional space inside the earphones or the audio speakers and inevitably increasing the size of the same.

SUMMARY OF THE DISCLOSURE

In order to overcome the aforementioned deficiency, the present disclosure provides a coaxial audio speaker using a single audio source. A bass sound unit may be co-axially disposed with and surrounding a treble sound unit, reducing the size of the audio speaker, enabling the bass vibration audio source point to be at the same horizontal level with the treble vibration audio source point, and realizing a broader range of electricity adjustability.

A coaxial audio speaker according to the present disclosure may include a treble sound unit with a treble vibration audio source point, a wiring board, and a treble sound hole. The same audio speaker may also include a bass sound unit having a magnetic-conductive base with a center portion of the magnetic-conductive base defining a hollow treble positioning surface. A main body of the magnetic-conductive base may define an auxiliary magnetic adjoining space and a vocal coil movement space adjacent to the auxiliary magnetic adjoining space and separated from each other by a separating wall. The bass sound unit may include a ring-shaped magnet having a first surface and a second surface opposite to the first surface. The first surface may be stationed within the vocal coil movement space, and the ring-shaped magnet may be fixed within the vocal coil movement space and away from the separating wall to form a magnetic gap between the ring-shaped magnet and the separating wall. The bass sound unit may also include a magnetic-conductive ring disposed on the second surface of the ring-shaped magnet and an opening defined by the magnetic-conductive ring and the magnetic-conductive base. The bass sound unit may further include a vibrating vocal tone diaphragm with a hollow diaphragm membrane on which a vocal coil is connected. A position where the vocal coil and the hollow diaphragm membrane connect may define a bass vibration audio source point, the vibrating vocal tone diaphragm may be fixed within the opening to enclose the opening, and the vocal coil may extend into the vocal coil movement space and position within the magnetic gap. Plus, the bass sound unit may include a wiring board adjoined on an external wall of a bottom surface defining the vocal coil movement space for positioning wires of the vocal coil. The bass sound unit and the treble sound unit may be coaxially disposed and the treble sound unit may be surrounded by the bass sound unit. The bass vibration audio source point may horizontally align with the treble vibration audio source point.

Specifically, the treble sound unit is a moving iron sound unit, a circular electromagnetic sound unit, a rectangular electromagnetic moving iron sound unit, a moving-vocal coil sound unit, a ribbon-type sound unit, a piezo-ceramic sound piece component, a piezo-ceramic sound piece adjoining another vibrating vocal tone diaphragm, or a semiconductor chip sound unit.

Specifically, a magnetic resistant ring may be disposed at the position where the co-axially disposed bass sound unit and treble sound unit adjoin, for separating a magnetic field of the bass sound unit and a magnetic field of the treble sound unit.

Specifically, the vibrating vocal tone diaphragm may further include an external pressurized frame positioned at an outer ring edge of the diaphragm membrane and an inner pressurized frame positioned at an inner ring edge of the diaphragm membrane, and the inner pressurized frame and the outer pressurized frame may connect to an inner edge and an outer edge of the magnetic-conductive base, respectively, to position the diaphragm membrane above the opening to enclose the opening.

Specifically, a vent hole may be disposed on the bottom surface defining the vocal coil movement space allowing for an air associated with the vibration of the vibrating vocal tone diaphragm to be channeled out of the vocal coil movement space.

Specifically, a flow damping gauze may be included to be adhesively attached on the external wall of the bottom surface of the magnetic-conductive base for covering the vent hole and adjusting an air flow within the vocal coil movement space, and a dust cover may be above the bass sound unit allowing for the sound of the bass sound unit to be transmitted out of a bass sound hole of the dust cover.

The diaphragm membrane may be in form of composite diaphragm material.

The auxiliary magnetic adjoining space may be in the proximity of the treble positioning surface while the vocal coil movement space may be away from the treble positioning surface.

An auxiliary magnet may be adjoined within the auxiliary magnetic adjoining space.

The auxiliary magnetic adjoining space in another implementation may be away from the treble positioning surface while the vocal coil movement space may be in the proximity of the treble positioning surface instead.

The auxiliary magnet may be adjoined within the auxiliary magnetic adjoining space.

For further understanding of the present disclosure, reference is made to the following detailed description illustrating the embodiments and examples of the present disclosure. The description is only for illustrating the present disclosure, not for limiting the scope of the claim.

BRIEF DESCRIPTION OF THE DRAWINGS

The drawings included herein provide further understanding of the present disclosure. A brief introduction of the drawings is as follows.

DESCRIPTION OF THE EXEMPLARY EMBODIMENTS

The aforementioned and other technical contents, features, and efficacies will be shown in the following detail descriptions of a preferred embodiment corresponding with the reference Figures.

Figure 1:
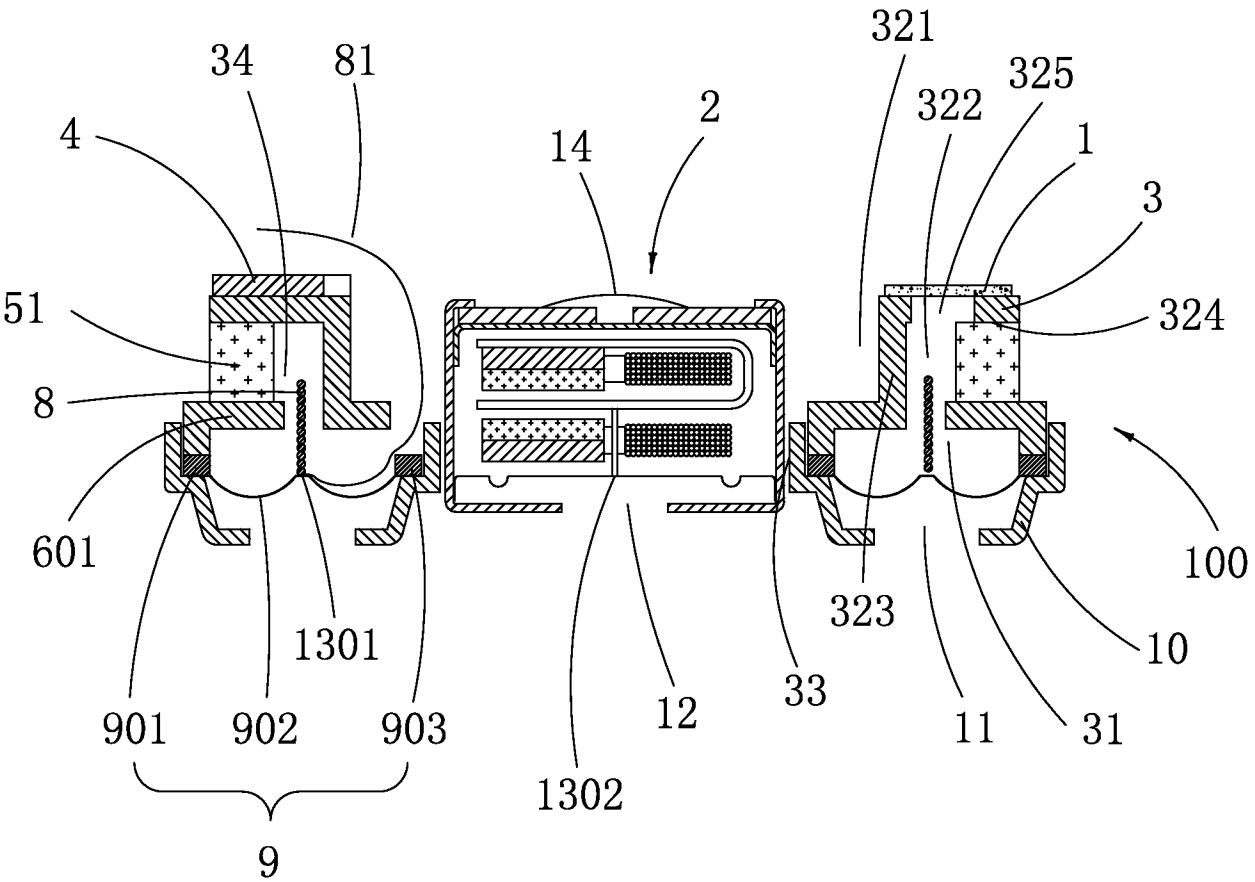
FIG. 1 is a cross-sectional view of a coaxial audio speaker according to one embodiment of the present disclosure.

Please refer to FIG. 1 illustrating a coaxial audio speaker using a single audio source according to one embodiment of the present disclosure. The audio speaker may include a bass sound unit 100 and a treble sound unit 2, with the bass sound unit 100 and the treble sound unit 2 coaxially disposed. And the bass sound unit 100 may coaxially surround the treble sound unit 2. The treble sound unit 2 may include a treble vibration audio source point 1302 and a wiring board 14 for the treble sound unit 2. A treble sound hole 12 may be disposed on the treble sound unit 2 allowing for the sound from the treble sound unit 2 to be transmitted out. In one implementation, the treble sound unit 2 may be a moving iron treble sound unit.

The bass sound unit 100 may be implemented in terms of a single magnetic gap mechanism. The bass sound unit 100 may include a ring-shaped magnetic-conductive base 3. A center portion of the magnetic-conductive base 3 may have a hollow treble positioning surface defined. A main body of the magnetic-conductive base 3 may include an auxiliary magnetic adjoining space 321 and a vocal coil movement space 322 adjacent to the auxiliary magnetic adjoining space 321. The auxiliary magnetic adjoining space 321 and the vocal coil movement space 322 may be separated from each other by a separating wall 323. A cross-section of the conductive-magnetic base 3 may be Z-shaped. A vent hole 325 may be disposed on a bottom surface 324 of the vocal coil movement space 322. As shown in FIG. 1, the auxiliary magnetic adjoining space 321 may be in the proximity of the treble positioning surface 33 while the vocal coil movement space may be away from the treble positioning surface 33.

Figure 2:
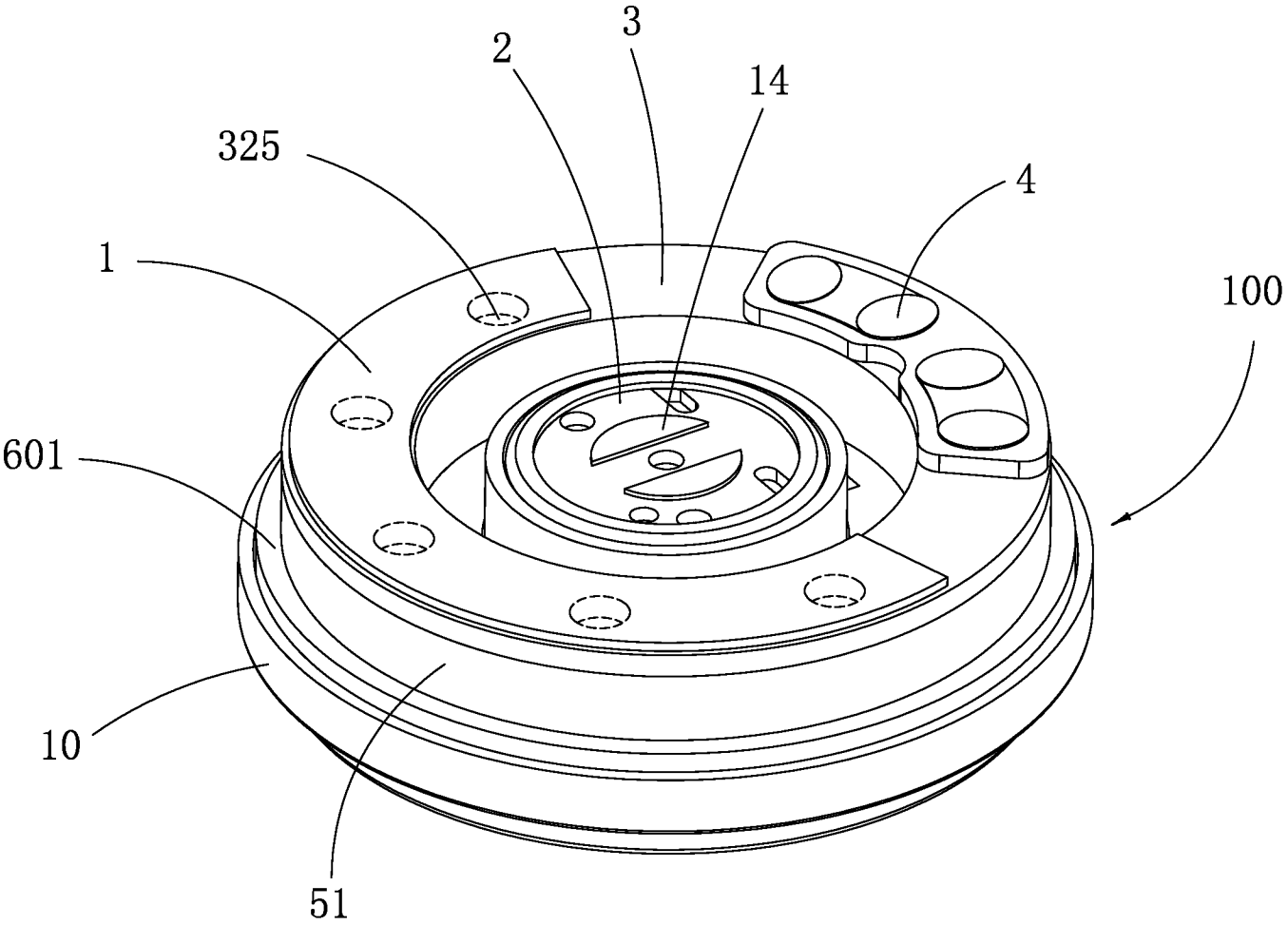
FIG. 2 shows a schematic diagram of an audio speaker according to one embodiment of the present disclosure.
Figure 3:
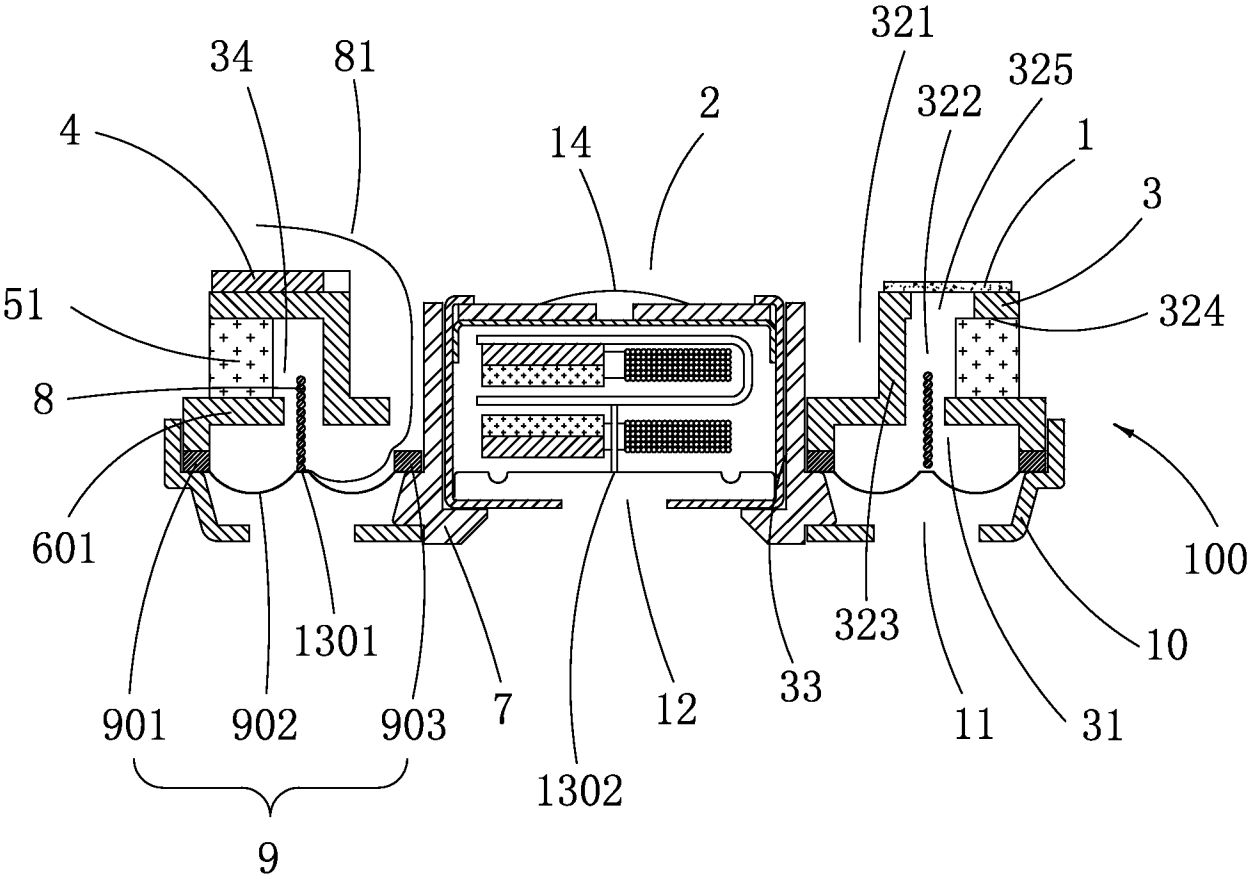
FIG. 3 shows another cross section of an audio speaker according to one embodiment of the present disclosure.
Figure 4:
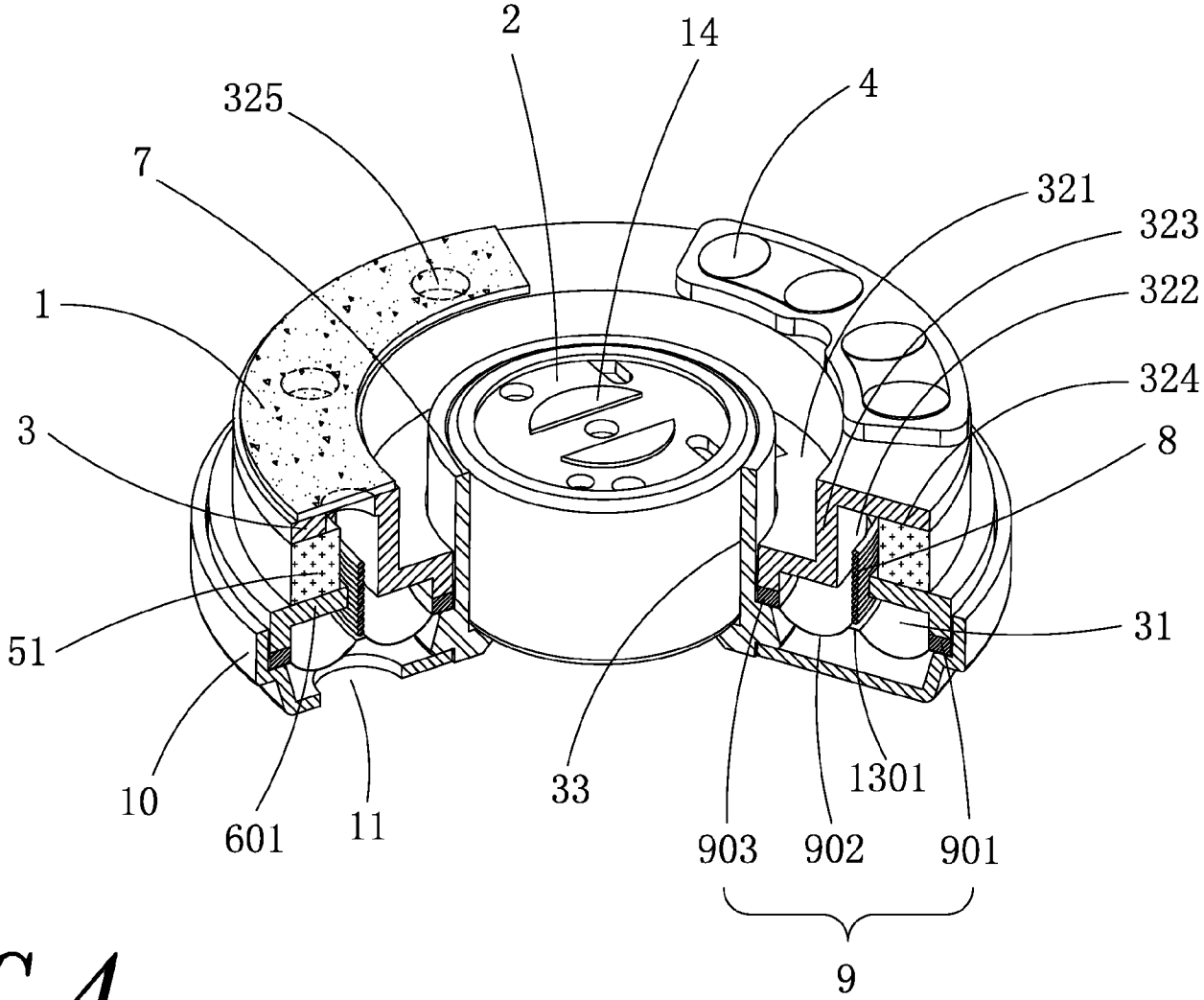
FIG. 4 shows a partial cross section of an audio speaker according to one embodiment of the present disclosure.

Please refer to FIGS. 2-4. A magnetic resistant ring 7 may be adjoined with the treble positioning surface 33. The magnetic resistant ring 7 may be implemented in terms of a column structure allowing for the treble sound unit 2 to pass and be positioned. The magnetic resistant ring 7 may connect to the treble positioning surface 33 of the magnetic-conductive base 3. As such, the magnetic resistant ring 7 may separate magnetic fields from the bass sound unit 100 and the treble sound unit 2.

Please refer to FIGS. 1-4 again. A ring-shaped magnet 51 may be stationed on the bottom surface 324 of the vocal coil movement space 322. The width and height of the cross-section of the ring-shaped magnet 51 may be less than the width and height of the cross-section of the vocal coil movement space 322. The magnet 51 may be adhered to the vocal coil movement space 322 and away from the auxiliary magnetic adjoining space 321. Since the width of the magnet 51 is less than the width of the vocal coil movement space 322 as previously mentioned, the magnet 51 may not entirely fill out the vocal coil movement space 322. Consequently, a magnetic gap 34 may be formed in the proximity of the separating wall 323 and the auxiliary magnetic adjoining space 321.

The top surface of the magnet 51 may be adhesively attached to a magnetic-conductive ring 601. Both the magnetic-conductive ring 601 and the magnet 5 may be positioned within the vocal coil movement space 322.

An opening 31 may be formed between the magnetic-conductive base 3 and the magnetic-conductive ring 601. The opening 31 may be integrated with a vibrating vocal tone diaphragm 9. The vibrating vocal tone diaphragm 9 may be composed by a ring-shaped external pressurized frame 901, a hollow diaphragm membrane 902, and a ring-shaped internal pressurized frame 903. The ring-shaped diaphragm membrane 902 may be with an outer ring edge and an inner ring edge. The inner ring edge may be where the ring-shaped inner pressurized frame 903 is positioned while the outer ring edge may be where the ring-shaped external pressurized frame 901 is positioned. A vocal coil 8 may be connected to the diaphragm membrane 902 between the external pressurized frame 901 and the internal pressurized frame 903. The position where the vocal coil 8 connects to the diaphragm membrane 902 may be where a bass vibration audio source point 1301 is formed. As the external pressurized frame 901 and the internal pressurized frame 903 may be attached to the outer ring edge and the inner ring edge of the opening 31, respectively, the vocal coil 8 may be positioned within the vocal coil movement space 322 and within the magnetic gap 34 between the magnet 51 and the separating wall 323. The vibrating vocal tone diaphragm 9 may therefore enclose the opening 31.

Magnetic fields provided by the magnet 51 may be conductive present the magnetic-conductive ring 601 along with the vocal coil 8 and the providing the magnetic gap and the magnetic-conductive base 3 further serving to render conductive the magnetic fields. A vent hole 325 may allow for the air associated with the vibration of the vibrating vocal tone diaphragm 9 to be channeled out. It is worth noting that another side of the magnet 51 may extend out of the coil movement space 322, enhancing the magnetic force of the magnetic gap.

Figure 5:
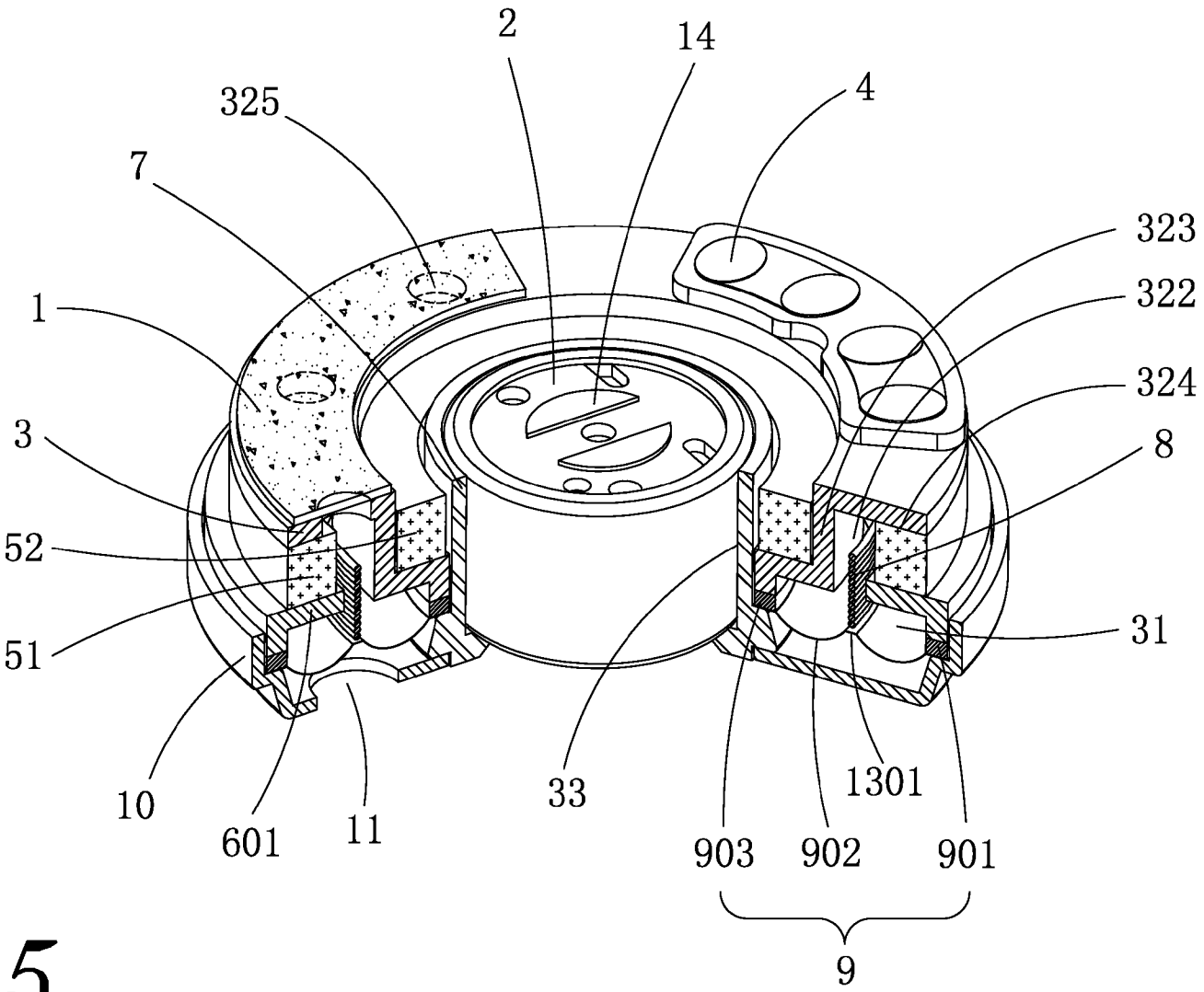
FIG. 5 is another partial cross section of an audio speaker according to one embodiment of the present disclosure.

Please refer to FIG. 5 showing another audio speaker according to one embodiment of the present disclosure. The auxiliary magnetic adjoining space 321 may be where an auxiliary magnet 52 is stationed. The size of the auxiliary magnet 52 may be smaller than that of the magnet 51, and the cross-sectional width and height of the auxiliary magnet 52 may be less than the cross-sectional width and height of the coil movement space 322. With the auxiliary magnet 52 and the magnetic-conductive base 3, which could conduct the magnetic fields, the overall magneticity may increase.

Figure 6:
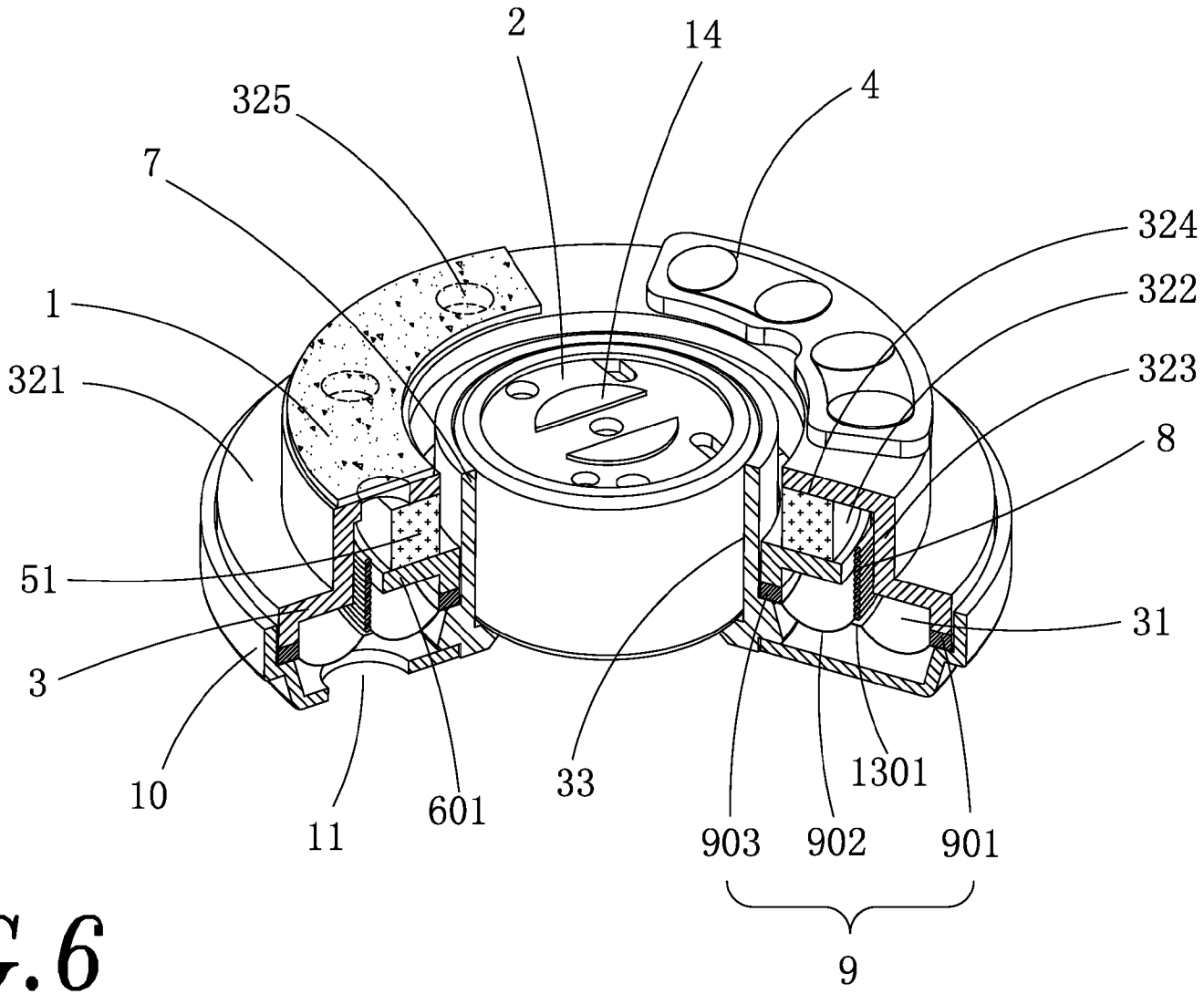
FIG. 6 is another partial cross section of an audio speaker according to one embodiment of the present disclosure.

Please refer to FIG. 6 showing another audio speaker according to one embodiment of the present disclosure. One major difference between the embodiment in FIG. 6 and the embodiment in FIGS. 1-4 may be the coil movement space 322 being in the proximity of the treble positioning surface 33 and the auxiliary magnetic adjoining space 321 being away from the treble positioning space 33. Thus, the cross section of the embodiment in FIG. 6 may be the opposite of the cross section of the embodiment in FIGS. 1-4.

Figure 7:
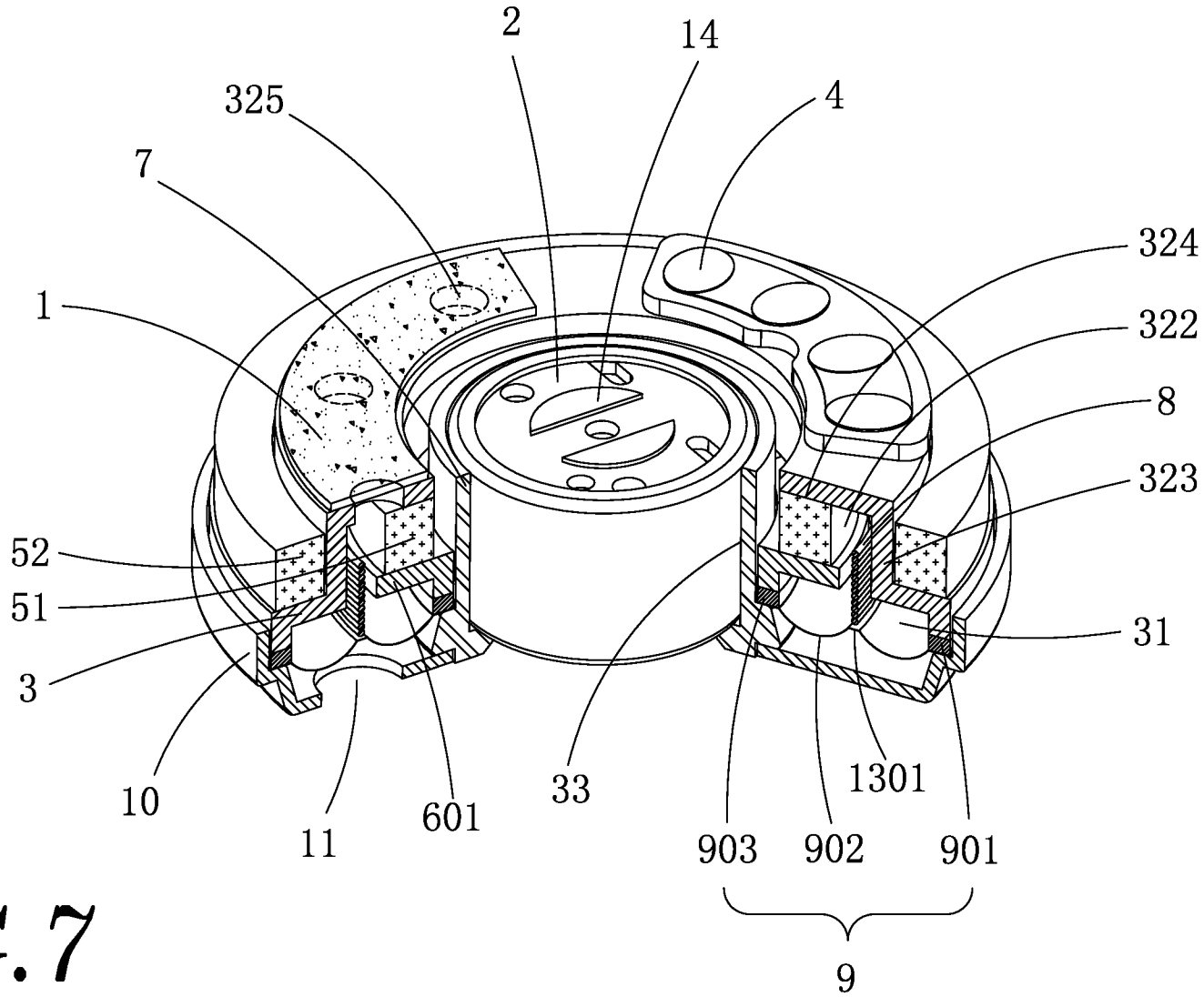
FIG. 7 is another partial cross section of an audio speaker according to one embodiment of the present disclosure.

As shown in FIG. 7, the auxiliary magnet nay be positioned within the auxiliary magnetic adjoining space 321 away from the treble positioning surface 33, without compromising the benefit associated with the embodiment in FIG. 6.

Figure 8:
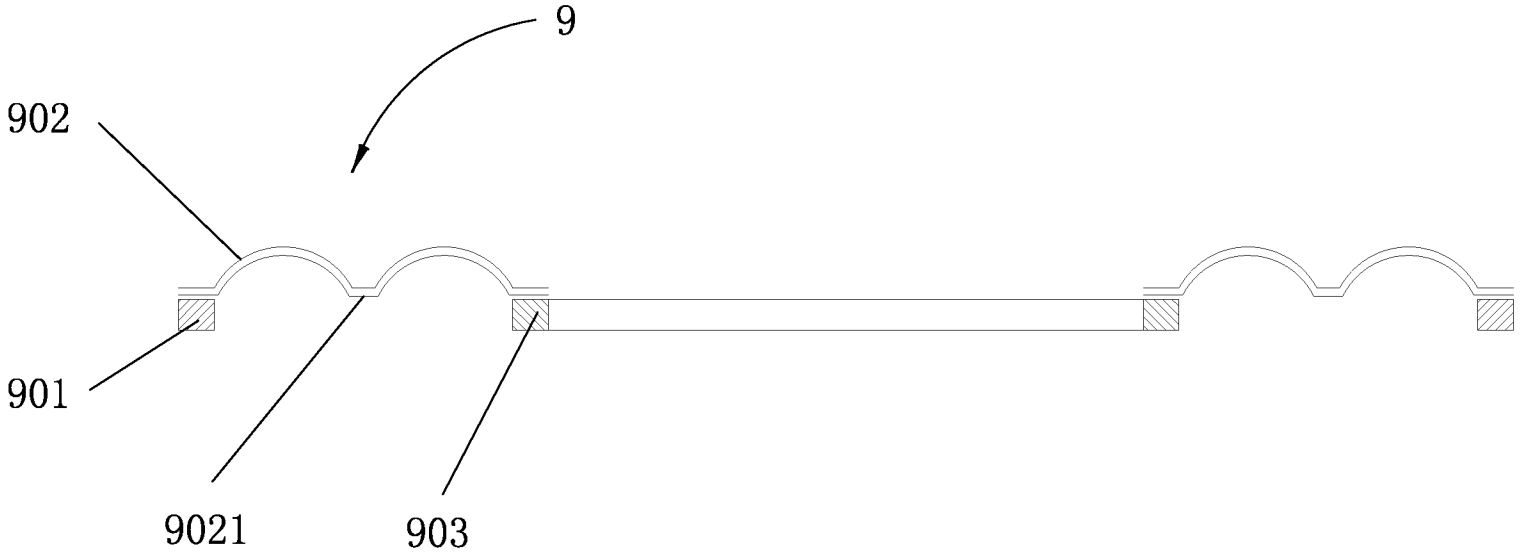
FIG. 8 is a schematic diagram of a vibrating vocal tone diaphragm of the audio speaker according to one embodiment of the present disclosure.

As shown in FIG. 8, the diaphragm membrane 902 may be a composite diaphragm material 9021. And the diaphragm membrane material 9021 may be polymer plastic, plastic polymer fibers, organic fibers, mineral matters or the like and in the form of a thin film. In another implementation, the diaphragm membrane 902 may be formed by braided-type punching and forming. The mineral matters may include metals, rocks, minerals, glasses, or combinations of the above. The external pressurized frame 901 or the internal pressurized frame 903 may not be ring-shaped. In other words, the external pressurized frame 901 or the internal pressurized frame 903 may be oval, triangular, rectangular, polygonal, or in other shape.

A wiring board 4 may be adhesively attached to an external wall of the coil movement space 322. The wiring board 4 may allow for wires 81 of the vocal coil 8 to be positioned.

The coupling between the treble sound unit 2 and the magnetic resistant ring 7 or the magnetic-conductive base 3 may be by adhesion, engaging, or other commercially available connecting approaches. The bass sound unit 100 may co-axially surround the treble sound unit 2 and the bass vibration audio source point 1301 of the bass sound unit 100 may be at the same horizontal level with the treble vibration audio source point 1302 of the treble sound unit 2. Thus, the audio speaker according to the present disclosure may be with a broader range of electricity adjustability even with one single audio source.

The wiring board 14 of the magnetized treble sound unit 2 and the wiring board 4 of the magnetized bass sound unit 100 may be connected to electrical signal wires.

The external surface of the bottom surface of the coil movement space 322 may be having flow damping gauze 1 adhesively attached. The flow damping gauze 1 may cover the vent hole 325 and may be for adjusting the air flow within the coil movement space 322.

Above the bass sound unit 100 where the vibrating vocal tone diaphragm is disposed may overlay a dust cover 10. A bass sound hole 11 may be disposed on the dust cover 10. The sound from the bass sound unit 100 may be channeled through the bass sound hole 11 of the dust cover 10.

Figure 9A:
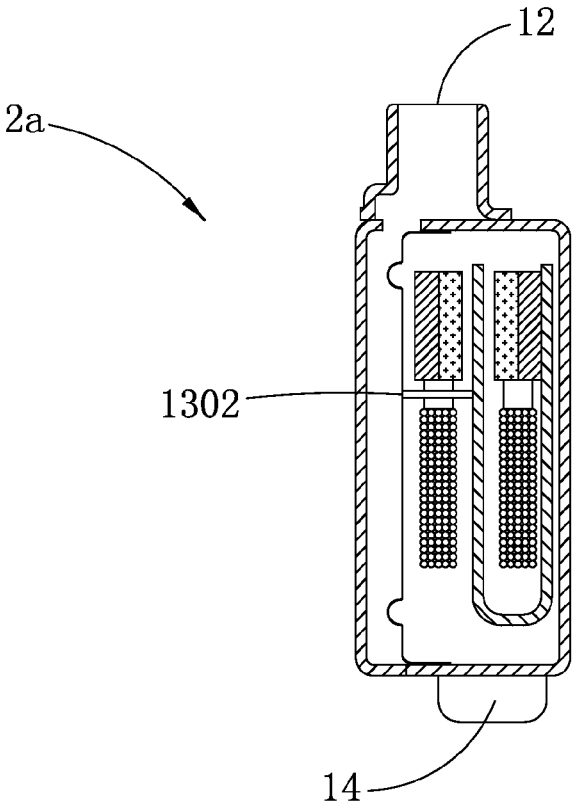
FIGS. 9A-9F show embodiments of a treble sound unit according to the present disclosure.
Figure 9B:
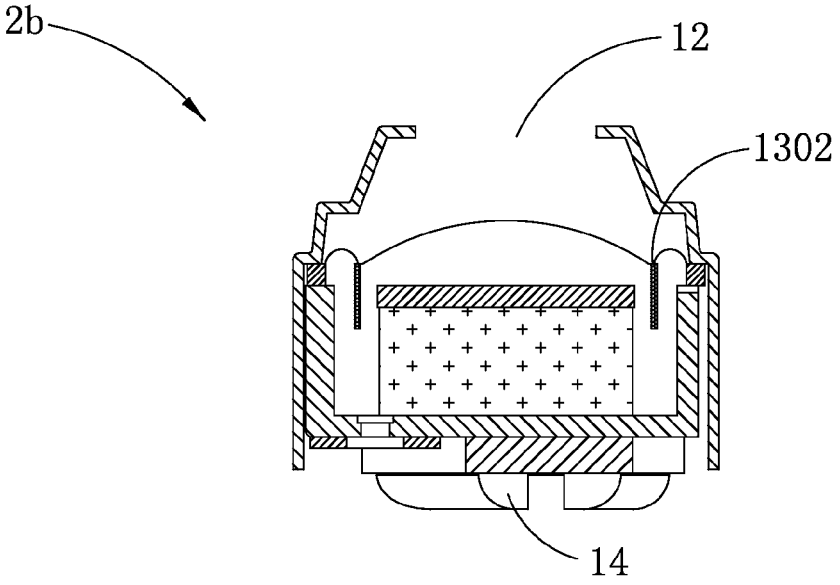
Figure 9C:
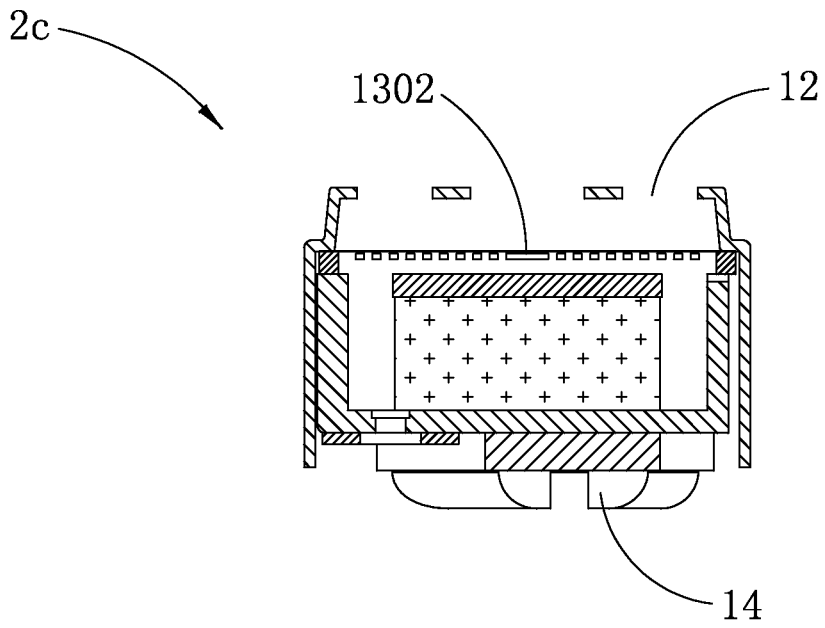
Figure 9D:
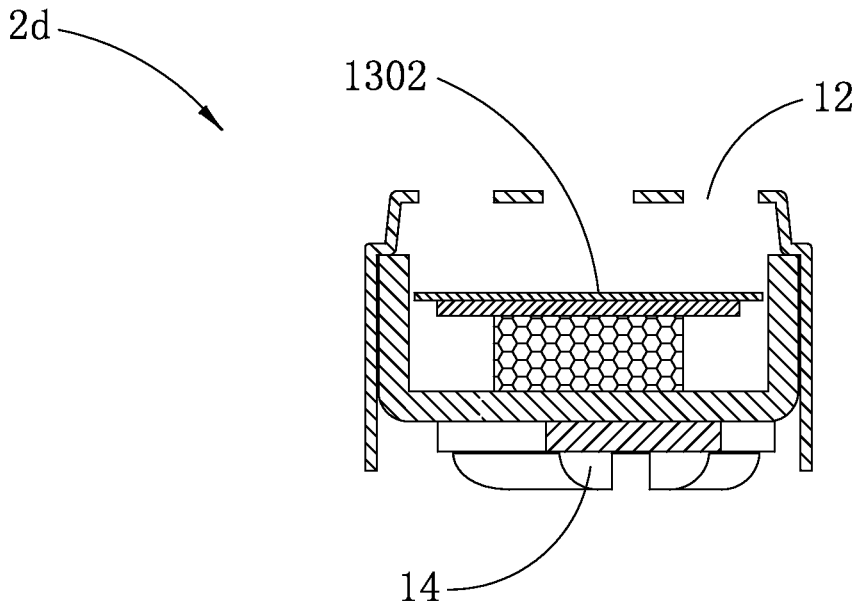
Figure 9E:
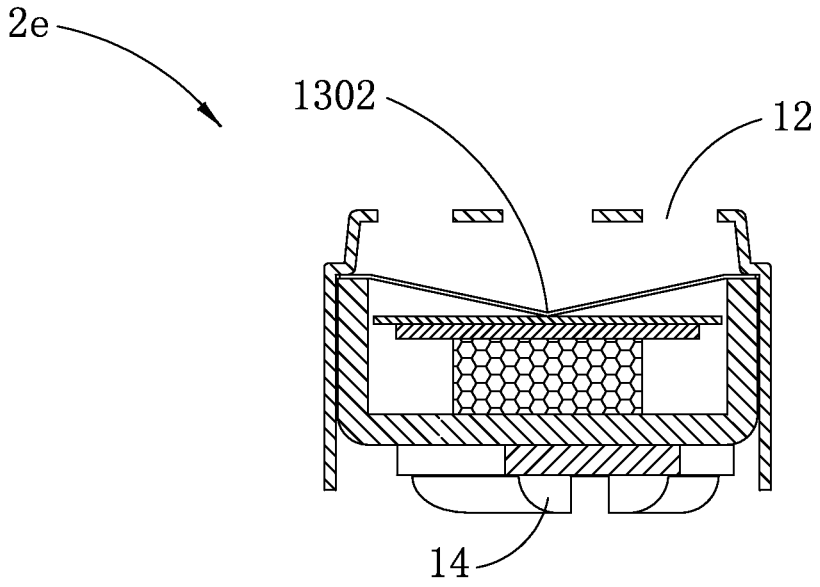
Figure 9F:
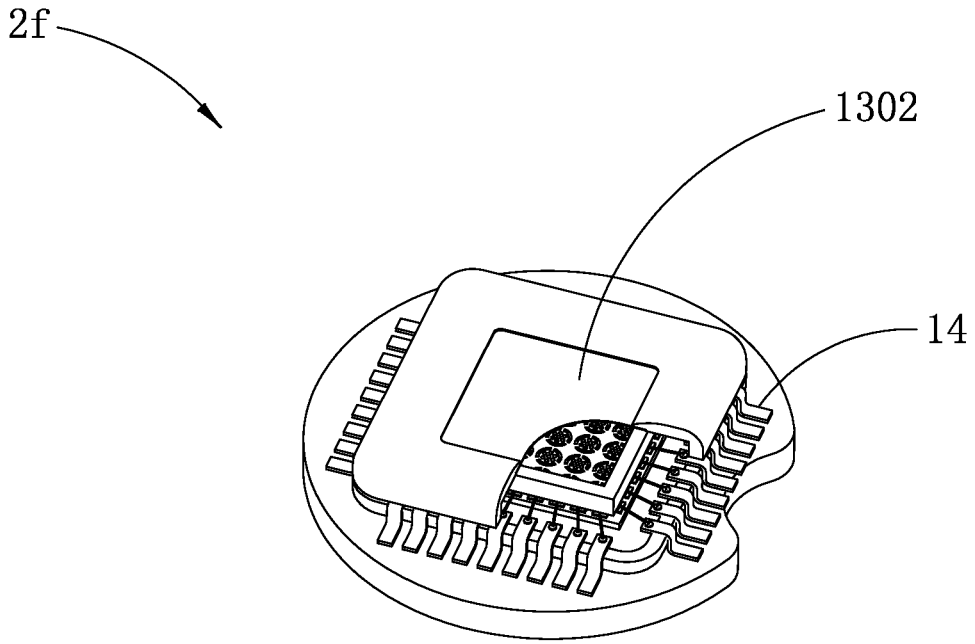

As shown in FIG. 9A to FIG. 9F, the treble sound unit 2 may be a rectangular electromagnetic moving iron sound unit 2*a* (FIG. 9A), a moving-vocal coil sound unit 2*b* (FIG. 9B), a ribbon-type sound unit 2*c* (FIG. 9C), piezo-ceramic sound piece components 2*d* (FIG. 9D), a piezo-ceramic sound piece adjoining another vibrating vocal tone diaphragm 2*e* (FIG. 9E), or a semiconductor chip sound unit 2*f* (FIG. 9F). Each of the treble sound units 2*a*-2*f* may be associated with the treble wiring board 14 and the treble vibration audio source point 1302. Except for the semiconductor chip sound unit 2*f*, each of other treble sound unit embodiments may be with a treble sound hole 12.

The embodiments discussed in above may be applicable in a variety of different audio speakers or earphones. The earphones, for instance, may include in-ear headphones, ear canal headphones, back neck earphones, and headphones.

Some modifications of these examples, as well as other possibilities will, on reading or having read this description, or having comprehended these examples, will occur to those skilled in the art. Such modifications and variations are comprehended within this disclosure as described here and claimed below. The description above illustrates only a relative few specific embodiments and examples of the present disclosure. The present disclosure, indeed, does include various modifications and variations made to the structures and operations described herein, which still fall within the scope of the present disclosure as defined in the following claims.

What is claimed is:

1. A coaxial audio speaker comprising:

a treble sound unit with a treble vibration audio source point, a wiring board, and a treble sound hole; and a bass sound unit having:

a magnetic-conductive base with a center portion of the magnetic-conductive base defining a hollow treble positioning surface, and a main body of the magnetic-conductive base defining an auxiliary magnetic adjoining space and a vocal coil movement space adjacent to the auxiliary magnetic adjoining space and separated from each other by a separating wall;

a ring-shaped magnet having a first surface and a second surface opposite to the first surface, the first surface being stationed within the vocal coil movement space, the ring-shaped magnet being fixed within the vocal coil movement space and away from the separating wall to form a magnetic gap between the ring-shaped magnet and the separating wall;

a magnetic-conductive ring disposed on the second surface of the ring-shaped magnet and an opening defined by the magnetic-conductive ring and the magnetic-conductive base;

a vibrating vocal tone diaphragm with a hollow diaphragm membrane on which a vocal coil is connected, a position where the vocal coil and the hollow diaphragm membrane connect defining a bass vibration audio source point, the vibrating vocal tone diaphragm being fixed within the opening to enclose the opening, and the vocal coil extending into the vocal coil movement space and positioned within the magnetic gap; and a wiring board adjoined on an external wall of a bottom surface defining the vocal coil movement space for positioning wires of the vocal coil;

wherein the bass sound unit and the treble sound unit are coaxially disposed and the treble sound unit is adapted to be surrounded by the bass sound unit;

wherein the bass vibration audio source point horizontally aligns with the treble vibration audio source point.

2. The audio speaker according to claim 1, wherein the treble sound unit is a moving iron sound unit, a circular electromagnetic sound unit, a rectangular electromagnetic moving iron sound unit, a moving-vocal coil sound unit, a ribbon-type sound unit, a piezo-ceramic sound piece component, a piezo-ceramic sound piece adjoining another vibrating vocal tone diaphragm, or a semiconductor chip sound unit.

3. The audio speaker according to claim 1, further comprising a magnetic resistant ring disposed at the position where the co-axially disposed bass sound unit and treble sound unit adjoin, for separating a magnetic field of the bass sound unit and a magnetic field of the treble sound unit.

4. The audio speaker according to claim 1, wherein the vibrating vocal tone diaphragm further comprises an external pressurized frame positioned at an outer ring edge of the diaphragm membrane and an inner pressurized frame positioned at an inner ring edge of the diaphragm membrane, and the inner pressurized frame and the outer pressurized frame connect to an inner edge and an outer edge of the magnetic-conductive base, respectively, to position the diaphragm membrane above the opening to enclose the opening.

5. The audio speaker according to claim 1, wherein a vent hole is disposed on the bottom surface defining the vocal coil movement space allowing for an air associated with the vibration of the vibrating vocal tone diaphragm to be channeled out of the vocal coil movement space.

6. The audio speaker according to claim 5, further comprising a flow damping gauze adhesively attached on the external wall of the bottom surface of the magnetic-conductive base for covering the vent hole and adjusting an air flow within the vocal coil movement space, and a dust cover above the bass sound unit allowing for the sound of the bass sound unit to be transmitted out of a bass sound hole of the dust cover.

7. The audio speaker according to claim 1, wherein the diaphragm membrane is in form of composite diaphragm material.

8. The audio speaker according to claim 1, wherein the auxiliary magnetic adjoining space is in the proximity of the treble positioning surface while the vocal coil movement space is away from the treble positioning surface.

9. The audio speaker according to claim 8, wherein an auxiliary magnet is adjoined within the auxiliary magnetic adjoining space.

10. The audio speaker according to claim 1, wherein the auxiliary magnetic adjoining space is away from the treble positioning surface while the vocal coil movement space is in the proximity of the treble positioning surface.

11. The audio speaker according to claim 10, wherein an auxiliary magnet is adjoined within the auxiliary magnetic adjoining space.

* * * * *